350-336 SR
PTH29 XR 4,167,005

United States Patent [19]
Beauviala

[11] 4,167,005
[45] Sep. 4, 1979

[54] DEVICE FOR DISPLAYING FIGURES BY A COMBINATION OF CHARACTER SEGMENTS

[75] Inventor: Jean-Pierre Beauviala, Grenoble, France

[73] Assignee: Societe AATON, Grenoble, France

[21] Appl. No.: 911,222

[22] Filed: May 31, 1978

[30] Foreign Application Priority Data

Jun. 1, 1977 [FR] France ..... 77 16682
Jun. 24, 1977 [FR] France ..... 77 19376

[51] Int. Cl.[2] ..... G09F 9/32
[52] U.S. Cl. ..... 340/762; 340/756; 354/109
[58] Field of Search ..... 340/756, 759, 760, 762, 340/765; 354/109

[56] References Cited

U.S. PATENT DOCUMENTS

| | | | |
|---|---|---|---|
| 2,114,678 | 4/1938 | Funk | 340/756 X |
| 3,781,863 | 12/1973 | Fujita | 340/765 X |
| 3,877,015 | 4/1975 | Kanazaki et al. | 340/756 X |
| 3,903,519 | 9/1975 | Zega | 340/765 X |
| 3,953,868 | 4/1976 | Kawamura et al. | 354/109 |

*Primary Examiner*—David L. Trafton
*Attorney, Agent, or Firm*—J. Harold Nissen

[57] ABSTRACT

This device displays figures by a combination of five character segments.

A first character segment is located in the lower left-hand quadrant of a matrix and has the form of a deformed C. A second character segment is located in the upper left-hand quadrant of the matrix, the outline of which starts substantially from the center of the matrix, follows the left-hand half of the horizontal median line then at least the upper half of the left-hand vertical side. A third character segment is located in the upper right-hand quadrant and has substantially the form of an inversed C. A fourth character segment comprises a first horizontal section extending over a part of the lower side of the matrix, at the center thereof, and a second rectilinear section starting from the center of the first section and extending vertically or substantially vertically to a point in the right-hand half of the upper side. A fifth character segment is located in the bottom right quadrant and has substantially the form of an inversed C.

10 Claims, 6 Drawing Figures

DEVICE FOR DISPLAYING FIGURES BY A COMBINATION OF CHARACTER SEGMENTS

BACKGROUND OF THE INVENTION

The present invention relates to a device for displaying figures by a combination of the character segments. Hereinafter, display is understood to mean both optical display and printing on any support.

Display devices are already known, such as those used in computers, which show luminous figures constituted by combinations of seven character segments which are constituted by the small sides and the halves of the large sides of a slightly inclined parallelogram. These display devices enable legible but very geometrical figures to be obtained which may very easily be confused with one another as soon as they are observed in a direction other than the one normally provided for observing the display device. In particular, the 2 and 5 resemble each other as they are symmetrical with respect to a straight line; the same applies to the 6 and 9 which are symmetrical with respect to a point, the 3 resembles an E whilst the 4 resembles an h.

This defect is a particular hindrance when the display device is used for printing figures on a film since, in this case, these figures must sometimes be read by transparency, through the support.

SUMMARY OF THE INVENTION

It is an object of the present invention to remedy these drawbacks by providing a display device of simplified structure with respect to that of the known display devices and which enables very dissymetrical figures to appear which are the closest possible to the usual handwriting, avoiding any confusion during reading, said device employing only five character segments.

The device for displaying figures by combining character segments, according to the invention, comprises means for displaying at least one of the five elementary character segments and disposed so that said character segments overlap one another more or less in order to constitute rounded and continuous figures.

A figure may be displayed by the simultaneous appearance, at the same spot, of all the character segments necessary for reconstituting the figure. In this case, the display device comprises, at the same spot, a superposition of five transparent luminous elements or electrodes associated respectively with the five character segments.

The display may also be obtained by the sequential printing, on a mobile support, of the appropriate character segments at different spots along the path of the mobile support.

The display device according to the invention offers the advantage of being able to reconstitute any of the figures from 0 to 9, by means of a reduced number of elementary character segments and of allowing a non-ambiguous reading of these various figures.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
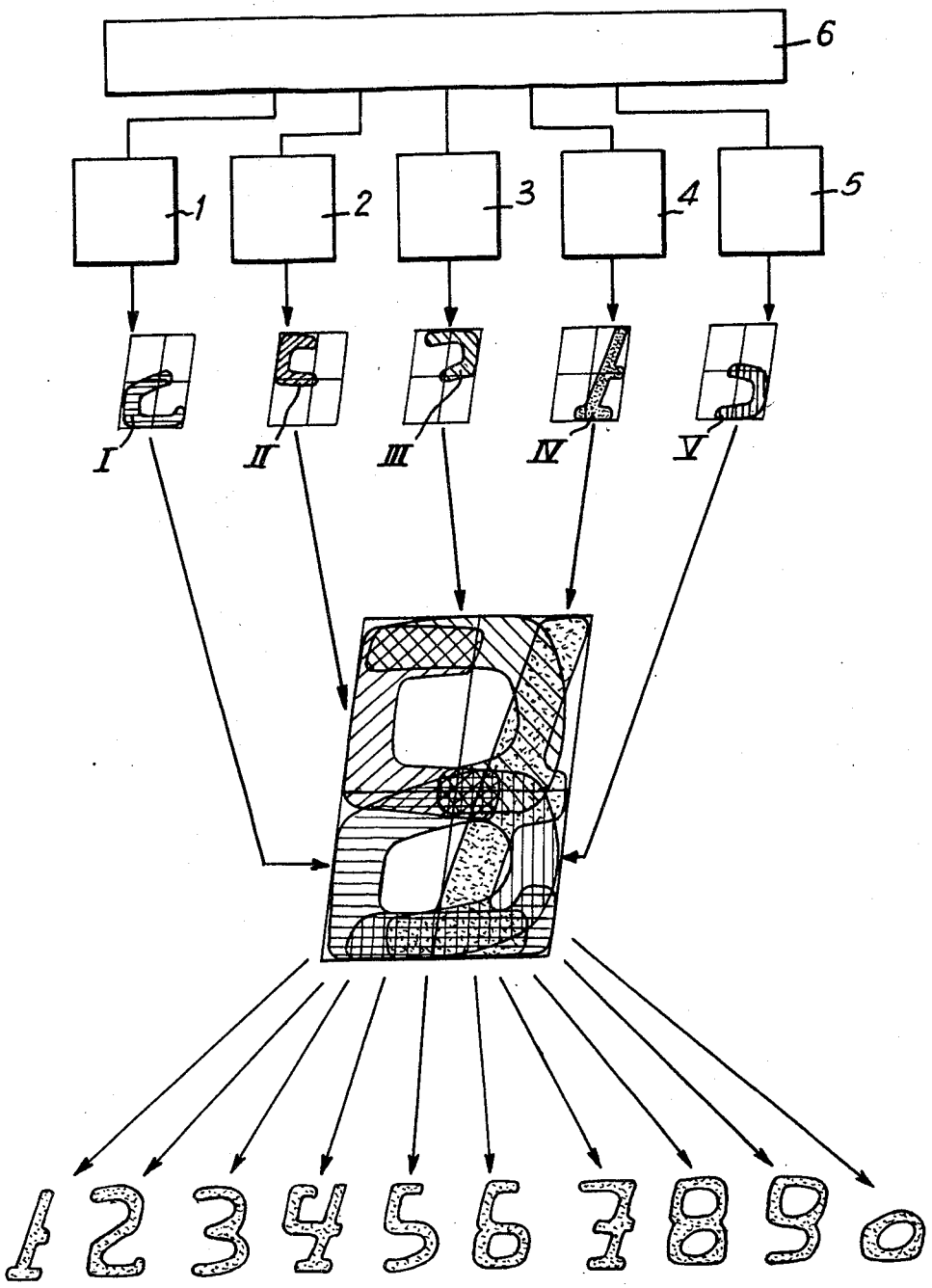
FIG. 1 is a block diagram of the display device according to the invention.

Referring now to the drawings, the essential elements constituting the display device according to the invention will firstly be described with reference to FIG. 1. It is obvious that the term "display" is understood to mean both the optical display of characters and the printing of these characters on a support such as a strip of paper; in both cases, it is an object of the device according to the invention to show figures either by display or by printing.

The display device according to the invention essentially comprises five individual display devices 1, 2, 3, 4, 5 which are intended to show respectively, by optical display or printing, five elementary character segments which are shown, in FIG. 1, to be associated with the display device and which are indicated by references I, II, III, IV and V. The five elementary display devices 1 to 5 are themselves connected to a character selection device 6 which provokes the selective excitation of one or more of the elementary display devices 1 to 5 depending on which character is to be displayed.

The manner in which are outlined the five elementary character segments I, II, III, IV and V which are used in combination to display all the ten figures from 0 to 9, as is indicated in the lower part of FIG. 1, will now be described.

Each of the elementary character segments has its own shape and it is placed, with respect to the others, in a well determined position. More particularly, the five elementary character segments occupy precise positions with respect to a matrix M having the form of a rectangle or a parallelogram either totally upright or slightly inclined upward to the right. The positions of the elementary character segments may be located with respect to the four quadrants defined within the matrix M by the two median lines parallel to the large side and the small side respectively.

The first character segment I is located in the lower left-hand quadrant of the matrix M and it is substantially in the form of a deformed C whose lower arm is, however, longer than the upper arm. The outline of this character segment starts substantially from the bottom right of the matrix M, it follows the lower side thereof, then the lower half of the left-hand vertical side and continues in section upwardly inclined to the right, terminating substantially at the centre of the matrix.

The second character segment II is located in the upper left-hand quadrant of the matrix M and it also has substantially the form of a C. Its outline starts from the centre of the matrix, follows the left-hand half of the horizontal median, then the upper half of the left-hand vertical side and terminates in a section following the left-hand half of the upper side of the matrix.

The third character segment III is located in the upper right-hand quadrant and it is substantially in the form of an inversed C, the upper arm of which is, however, longer than the lower arm. The outline of this segment starts from the centre of the matrix, follows the right-hand half of the horizontal median line, then the upper half of the right-hand vertical side, and terminates in a section along the right-hand half and part of the left-hand half of the upper side of the matrix.

The fourth character segment IV extends in the upper and lower right-hand quadrants. Its outline comprises a first horizontal section extending over part of the lower side of the matrix, at the centre thereof, and another section starting from the centre of the first section and extending upwardly to the right substantially to the top right of the matrix. This second section may be provided at its centre with an appendix extending slightly towards the right, substantially at the level of the right-hand half of the horizontal median.

Finally, the fifth character segment V which is located in the lower right-hand quadrant, is substantially in the form of an inversed C. Its outline starts from the centre of the matrix, follows the right-hand half of the horizontal median then the lower half of the right-hand vertical side and terminates in a section along the right-hand half and part of the left-hand half of the lower side of the matrix.

The character segment or segments which must appear to form one of the figures 0 to 9 will now be indicated hereinbelow:

Figure "1" illuminated segment IV
Figure "2" illuminated segments III and I
Figure "3" illuminated segments III and V
Figure "4" illuminated segments II and IV
Figure "5" illuminated segments II and V
Figure "6" illuminated segments I, II and V
Figure "7" illuminated segments III and IV
Figure "8" illuminated segments I, II, III and V
Figure "9" illuminated segments II, III, V or II, III, IV
Figure "0" illuminated segments I, V or II, III It is seen from above that the display device according to the invention enables any of Figures 0 to 9 to be displayed in perfectly recognizable and perfectly legible manner.

The figures thus obtained have a particular "roundness" which distinguishes them clearly from the figures obtained by combining rectilinear segments. This is due to the fact that, among the five elementary character segments used in combination, four are curved in shape, namely are in the form of a normal or inversed C. Furthermore, it should be noted that the five character segments overlap more or less to ensure the continuity of the final figure displayed. FIG. 1 also shows that the character segments I, II, III and V have their ends substantially superposed at the centre of the matrix. Similarly, the character segments II and III have their upper sections superposed in the left-hand half of the upper side of the matrix and the character segments I, IV and V have their lower sections superposed in the median part of the lower side of the matrix.

As has been said previously, the displayed figures may be formed by successive prints of the character segments I to V on a mobile support, or each figure may be displayed once by combination of several segments. In the latter case, the device has a structure which enables the elementary character segments to overlap.

In this case, the display of a figure may be obtained by the superposition, at the same spot, of five transparent luminous elements or electrodes having the form of the five character segments I, II, III, IV and V respectively. The display device may then be constituted by a stack of five fine transparent and electroluminescent branches, having shapes corresponding respectively to those of the five character segments, and being excitable individually (or illuminated separately by a source of light). To constitute the luminous elements displaying the five elementary character segments, electrodes may be used which enable phenomena of optical anisotropy to appear within a liquid crystal or electrodes composed of multiple small electroluminescent diodes which are contiguous, etc.

Figure 2:
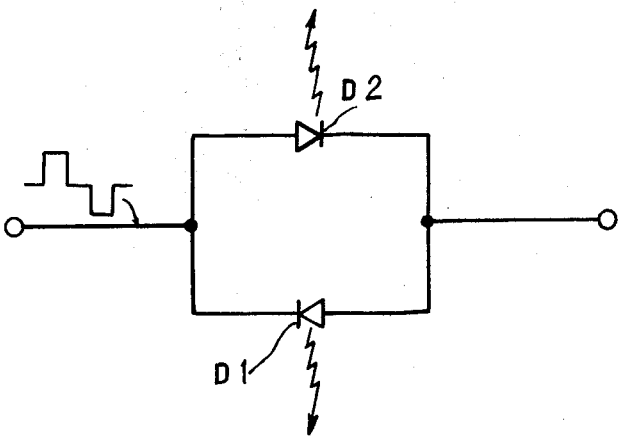
FIG. 2 is a partial electrical diagram of a circuit for exciting the luminous display elements.

FIG. 2 illustrates an electrical diagram which enables the number of electrical connection wires between the selective control device 6 and the various elementary display devices 1 to 5 which may be constituted by electroluminescent diodes, to be reduced. FIG. 2 shows two electroluminescent diodes D1, D2, which are used for displaying, in combination with masks perforated with slots, the two character segments I and II. The electroluminescent diodes D1, D2, are mounted head-to-tail and they are excited by pulses of inversed polarities. In this way, if during the period of time t allocated to the display, it is desired to display the two character segments I and II, a negative pulse is applied during the period t/2, to the electroluminescent diode D1 which then provokes the display of the character segment I, and during the other half-period t/2, a positive pulse is applied so that the electroluminescent diode D2 is then excited and controls the appearance of the luminous character segment II.

Figure 3:
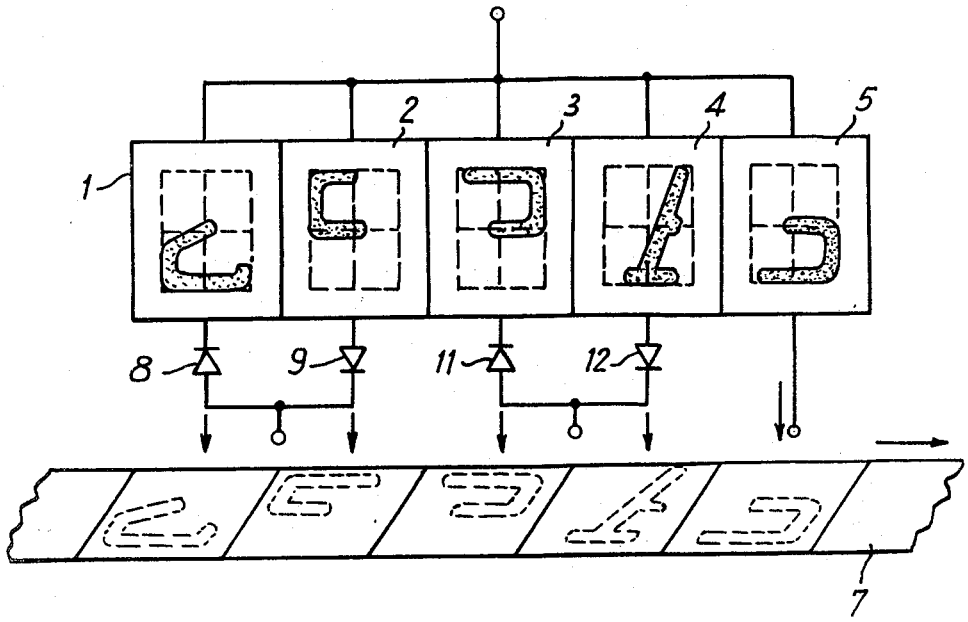
FIG. 3 is a diagram of a head for optical printing on film.

FIG. 3 shows the assembly of the five elementary display devices 1, 2, 3, 4, 5 constituting a head for optical printing on a film 7. The five elementary display devices 1 to 5 are disposed in this order in the direction of the path of the film 7 which is displayed intermittently. Each time the film stops, one or more of the elementary display devices 1 to 5 are excited and each emits a luminous character segment which produces an image on the film 7.

When a gauge of the film 7 has advanced opposite the assembly of the five elementary display devices 1–5, it has been printed by the combination of individual character segments which has been selected to produce the figure having to appear in this gauge.

FIG. 3 shows that, in accordance with the diagram of FIG. 2, the first two elementary display devices 1 and 2 are supplied in parallel with diodes 8 and 9 mounted head-to-tail respectively in series therewith, and in the same way the following two devices in the sequence, namely devices 3 and 4, are also connected in series with respective diodes 11 and 12 mounted head-to-tail.

Figure 4:
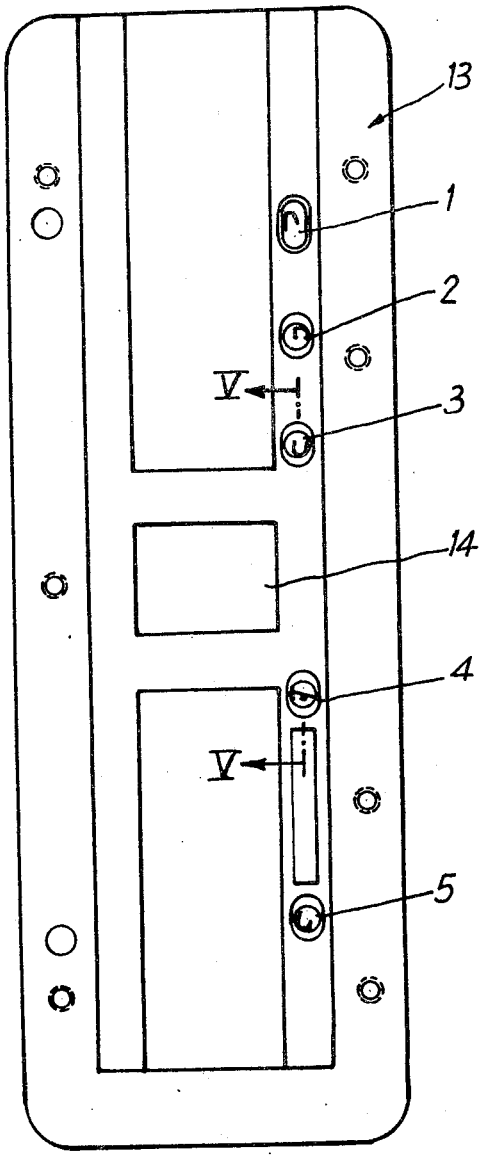
FIG. 4 is a view in elevation of a plate on the film path in a film camera and equipped with luminous display elements forming part of the display device according to the invention.
Figure 5:
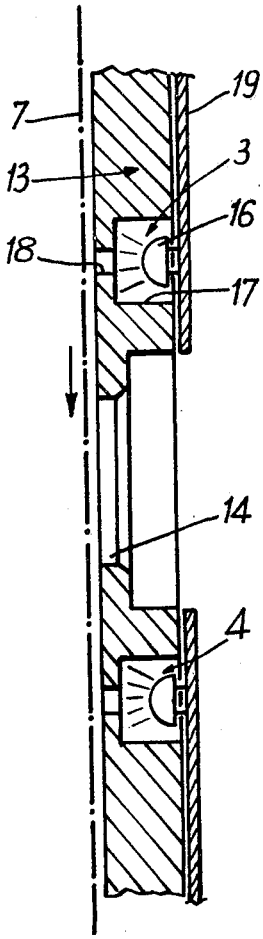
FIG. 5 is a view in longitudinal section along V—V of FIG. 4.

With particular reference to FIGS. 4 and 5, a practical embodiment of the device according to the invention will now be described, which is used for making figures in a marginal zone of a cinematographic film. The film 7 advances, in manner known per se, by being applied on a channel plate 13 which is perforated with a shot aperture 14. The channel plate 13 bears, on one of the longitudinal sides of the channel 15 in which film advances, the succession of the elementary display devices 1, 2, 3, 4 and 5 which respectively produce the display of the individual character segments I, II, III, IV and V. Naturally, these display devices are distributed at mutual distances such that the various elementary character segments may be combined and/or overlap in the same marginal zone of the film where a reference figure is to be formed.

As all the elementary display devices are made in the same manner, only one of them will be described in detail, namely the device 3 located just above the aperture 14. This device 3 comprises an electroluminescent diode 16 which is disposed in a housing 17 made in the front face of the channel plate 13. This housing communicates with the rear face of the channel plate 13 via a slot 18 of which the contour corresponds to the outline of the character segment having to be displayed, in the present case, segment III. This slot 18 may be made directly in the material constituting the channel plate 13 or it may be formed in an addded mask fixed on the rear face of the channel plate 13, at the location of the housing 17. In this way, when the electroluminescent diode 16 is excited, the slot 18 is illuminated by the diode and it may then form an image on the zone of the film 7 which is thereopposite, in order to ensure the printing on this film of the character segment III.

The electroluminescent diode 16, similarly to the other diodes of the other elementary display devices, are advantageously mounted on a printed circuit 19 borne by the front face of the channel plate 13.

Figure 6:
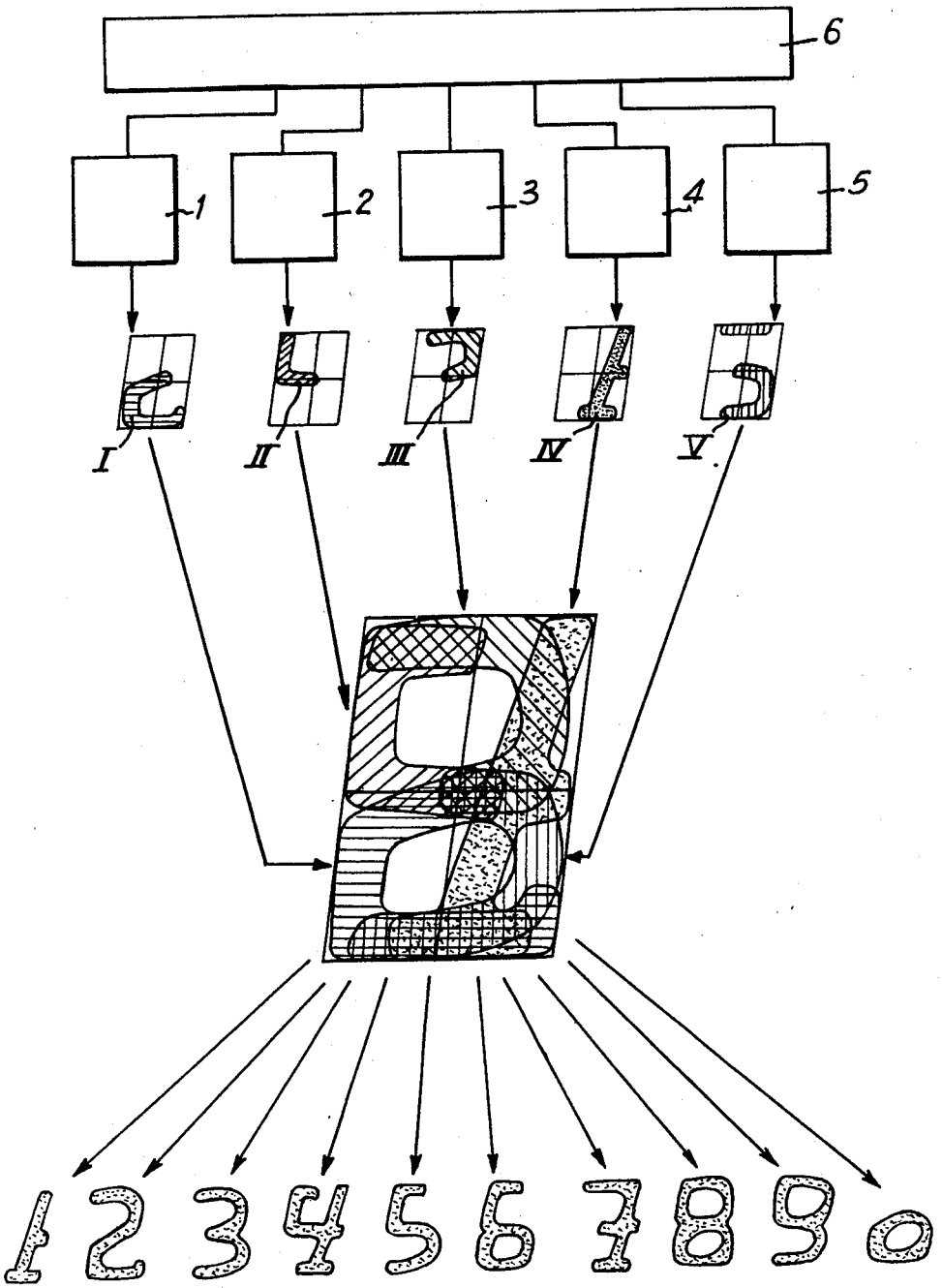
FIG. 6 is a block diagram of a variant embodiment.

In the diagram of FIG. 6 which shows a variant embodiment, the second character segment which is still located in the upper left-hand quadrant, is, however, in this case, in the form of a truncated C or of an L. In other words, its outline starts from the centre of the matrix, follows the left-hand half of the horizontal median and terminates in a section following the upper half of the left-hand vertical side of the matrix.

The fifth character segment V is constituted by two parts. In fact, it comprises a first, lower part which is the same as the one illustrated in FIG. 1. In the other words, this first part which is located in the lower right-hand quadrant, is substantially in the form of an inversed C and its outline starts from the centre of the matrix, follows the right-hand half of the horizontal median, then the lower half of the right-hand vertical side and terminates in a section along the right-hand half and part of the left-hand half of the lower side of the matrix.

In addition, the fifth character segment V comprises a second upper part which is constituted by a rectilinear section following the upper side of the matrix, on either side of the centre of said matrix.

The figures illustrated at the bottom of FIG. 6 are somewhat different from those shown at the bottom of FIG. 1. FIG. 6 shows in particular that the shape of Figures 4, 5 and 6 obtained, by the combination of the individual character segments shown in the upper part of FIG. 6, is much more characteristic than that of the corresponding figures in FIG. 1. Consequently, even if reading is effected in an inclined direction with respect to the plane of the support on which the figures are marked, all the individual figures are distinguished, without possible error. In particular, Figures 2, 3, 4 and 5 are particularly clearly legible and differentiated. This presents a particular advantage for the reading of the figures on a display screen of computers, watch dials, measuring apparatus and in the cinema industry for printing figures on a film.

What is claimed is:

1. A device for displaying figures by combination of elementary character segments, five in number, by showing, simultaneously or successively, at least one of the five elementary character segments, with shapes and positions determined with respect to a matrix in the form of a rectangle or parallelogram divided into four quadrants by its two median lines, and comprising two vertical or substantially vertical sides and two lower and upper sides, comprising first means for displaying a first character segment located in the lower left-hand quadrant of the matrix, in the form of a deformed C and the outline of which starts substantially from the bottom right of the matrix, follows the lower side and a part of the lower half of the left-hand vertical side and continues in a section inclined upwardly to the right, terminating substantially at the centre of the matrix; second means for displaying a second character segment located in the upper left-hand quadrant, the outline of which starts substantially from the centre of the matrix, follows the left-hand half of the horizontal median line then at least the upper half of the left-hand vertical side; third means for displaying a third character segment located in the upper right-hand quadrant, substantially in the form of an inversed C and the outline of which starts from the centre of the matrix, follows the right-hand half of the horizontal median line, then the upper half of the right-hand vertical side and terminates in a section along the right-hand half and part of the left-hand half of the upper side of the matrix; fourth means for displaying a fourth character segment of which the outline comprises a first horizontal section extending over a part of the lower side of the matrix, at the centre thereof, and a second rectilinear section starting from the centre of the first section and extending vertically or substantially vertically to a point in the right-hand half of the upper side, and fifth means for displaying a fifth character segment located in the bottom right quadrant, substantially in the form of an inversed C and the outline of which starts substantially from the centre of the matrix, follows the right-hand half of the horizontal median line, then the lower half of the right-hand vertical side and terminates in a section along the right-hand half and part of the left-hand half of the lower side of the matrix.

2. The device of claim 1, wherein the second means are provided to display a second character segment substantially in the form of a C, whose outline additionally comprises a section along the left-hand half of the upper side of the matrix, and the fourth means are provided to display a fourth character segment of which the second rectilinear section extends upwardly to the right substantially to the top right of the matrix.

3. The display device of claim 1, wherein the second means are provided to display a second character segment in the form of an L and the fifth means are provided to display a fifth character segment in two parts comprising, in addition to the first part in the form of an inversed C in the lower right-hand quadrant, a second upper part comprising a section extending along at least a part of the upper side of the matrix, on either side of the centre of this side.

4. The display device of claim 1 comprising, at the same spot, a superposition of five transparent luminous elements or electrodes respectively having the form of the five character segments and means for individually exciting each of the transparent luminous elements or electrodes.

5. The display device of claim 1, wherein the means displaying the various elementary character segments are grouped in pairs and are supplied with electrical pulses of inversed polarities and comprising diodes mounted head-to-tail so that a pulse of determined polarity excites only one of the said means of each pair.

6. The display device of claim 5, wherein the diodes mounted head-to-tail are electroluminescent diodes forming part of the elementary luminous display device serving to display the various individual character segments.

7. The display device of claim 1, usable for printing on a cinematographic film advancing in a channel plate of a film camera, comprising, in the channel plate and in the direction of movement of the cinematographic film, five housings disposed opposite the same marginal strip of the film where the figures are to be marked, slots enabling these various housings to communicate respectively with the rear face of the channel plate, against which is applied the cinematographic film, the contours of these slots corresponding respectively to the outlines of the five character segments, and luminous sources placed respectively in the housings which open into the front face of the channel plate.

8. The display device of claim 7, wherein the light source placed in each housing of the channel plate is constituted by an electroluminescent diode and comprising a printed circuit provided on the front face of the channel plate and bearing the five electroluminescent diodes.

9. The display device of claim 7, in which the slot of each housing of which the contour corresponds to the outline of the character segment having to be displayed in luminous form, is formed directly in the material of the channel plate.

10. The display device of claim 7, wherein the slot whose contour corresponds to one of the character segments is formed in a mask added to the housing.

* * * * *